United States Patent [19]

Weber

[11] 4,197,785

[45] Apr. 15, 1980

[54] HYDRAULIC ACTUATOR CUSHIONING DEVICE

[76] Inventor: William R. Weber, 4200 50th Ave., NE., Seattle, Wash. 98105

[21] Appl. No.: 807,226

[22] Filed: Jun. 16, 1977

[51] Int. Cl.[2] ..... F15B 11/08; F15B 13/042

[52] U.S. Cl. ..... 91/468; 91/443; 91/446; 137/596.2

[58] Field of Search ..... 137/596.2; 91/446, 468, 91/442, 268, 452, 443, 463, 455, 454; 92/143, 85

[56] References Cited

U.S. PATENT DOCUMENTS

| | | | |
|---|---|---|---|
| 1,599,199 | 9/1926 | Bayles | 92/143 X |
| 3,043,277 | 7/1962 | Carlson | 91/443 X |
| 3,045,697 | 7/1962 | Seguenot | 91/446 X |
| 3,779,136 | 12/1973 | Hohlein | 91/446 X |
| 3,963,045 | 6/1976 | Damitz | 91/468 X |

*Primary Examiner*—Irwin C. Cohen

[57] ABSTRACT

A device for cushioning hydraulic actuators at the end of travel including a unique valve responsive to hydraulic pressure which, one when under system return pressure ports fluid to a chamber of less volume than the actuator cylinder and then through a line restriction for reduced fluid flow and the consequential slowing of the actuator and two when system pressure is off, drains the chamber for use during the next cycle.

3 Claims, 15 Drawing Figures

HYDRAULIC ACTUATOR CUSHIONING DEVICE

This invention relates primarily to cushioning of linear hydraulic actuators at one or both ends of rod travel; however, the invention has other possible applications, as a flow control device. It can be used to reduce the terminal speed of rotary or pneumatic actuators. The invention is intended for use in systems which require complete movement of the actuator rod each sequence with sufficient dwell at the end positions to allow the included chamber to empty.

Hydraulic actuators are often used in remote or enclosed areas that are relatively inaccessible for maintenance or adjustment. The invention allows the use of less expensive actuators, without built-in cushioning, in these areas. Using the invention, cushioning and rate of actuator rod deceleration, can be adjusted remotely. Other advantages of the invention are that it requires no electrical power, timed solenoid valves or other unreliable means to accomplish remote cushioning.

The above and other advantages and features of the present invention will become apparent upon making reference to the specification to follow, the claims and the drawings wherein:

Figure 1:
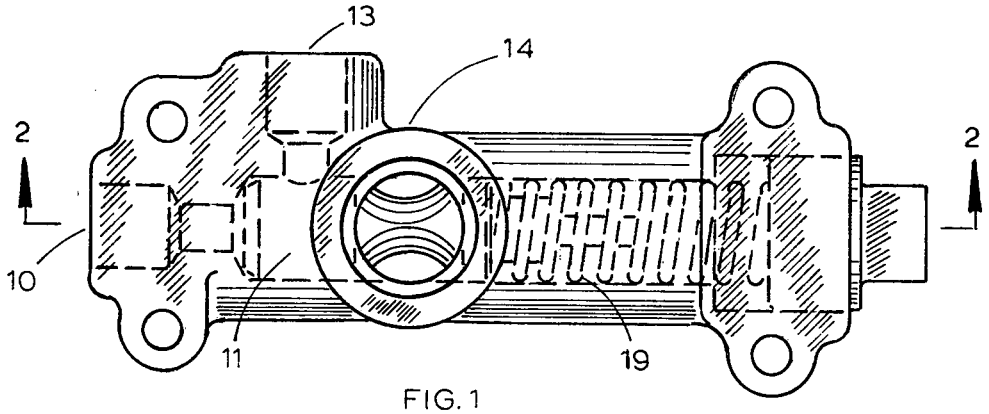
FIG. 1 shows a plan view of the unique valve mentioned above and referred to as a flow control valve hereinafter.
Figure 2:
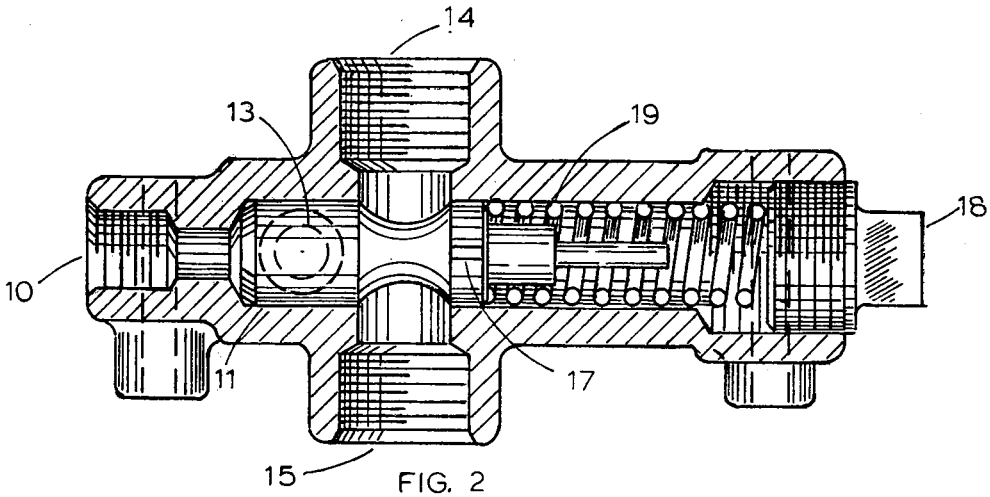
FIG. 2 is a section through FIG. 1 as indicated.
Figure 3:
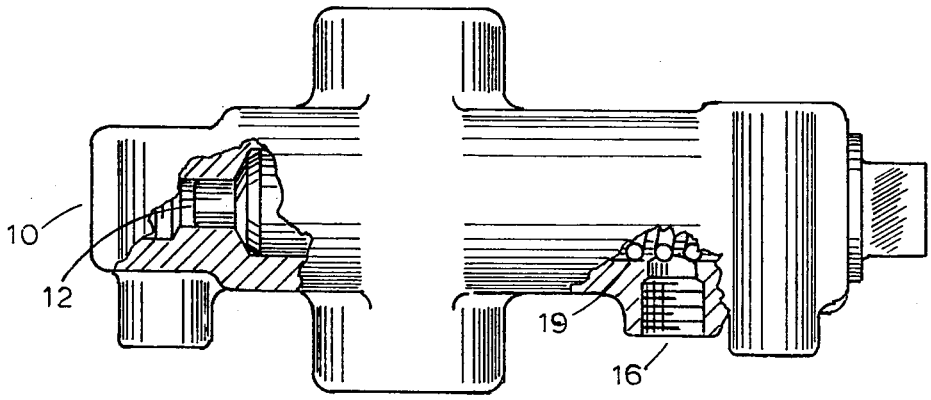
FIG. 3 is a side view of the flow control valve with additional features to allow its use for cushioning in one direction only on a double acting actuator as illustrated in FIG. 6.
Figure 4:
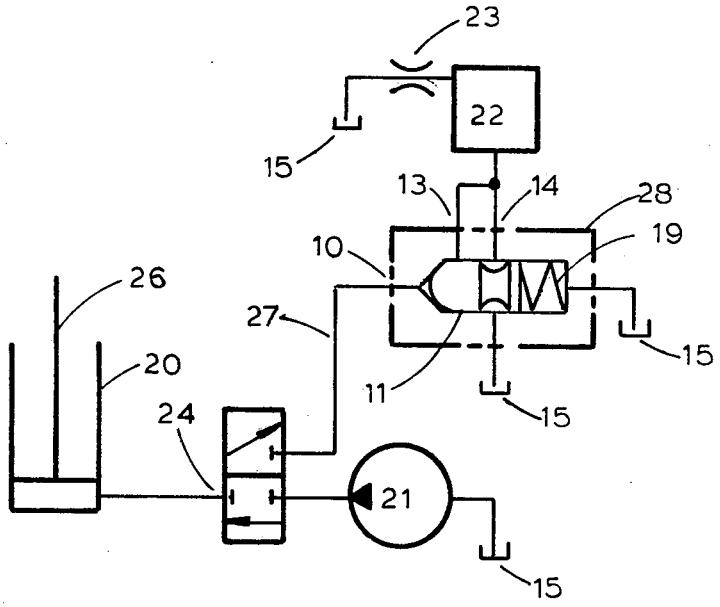
FIG. 4 shows schematically the invention used with a single acting actuator.

FIGS. 1 thru 3 show the flow control valve 20 which is designed to respond to the system pressure, automatically porting fluid as will be described. FIG. 4 depicts one method in which the invention can be used to cushion a hydraulic actuator remotely. The system is shown with the pump 22, two way selector valve 24 and single acting hydraulic actuator 25. The rod 26 in the actuator 25 is extended by proper movement of the selector valve 24. No cushion is provided for the actuator in the extend direction. When selector valve 24 is moved to the actuator rod retract position, the rod 26 moves down pressurizing line 28 to port 30 of the flow control valve 29. This return pressure causes the flow control valve spool 32 to move compressing spring 34, whose cavity is vented to drain at 36 while closing the flow control valve ports 38 and 40 and opening port 42. Return fluid flows thru port 42 and into chamber 44 at a fast rate. The volume of chamber 44 is less than that of the cylinder of the actuator 25, thus prior to bottoming of the actuator piston 26, at the end of actuator rod stroke, chamber 44 is filled and fluid must pass through the line restrictor 46 at a lower rate than when filling chamber 44, cushioning the actuator rod 26. At the end of the actuator rod 26 retract stroke, the return pressure at 30 drops to zero and spring 34 returns the flow control valve spool 32 to its original position, opening ports 38 and 40, dumping the fluid in chamber 44 to drain 40.

The system shown in FIG. 4 is used in special applications and it is assumed that sufficient tonnage is on the rod 26 to cause it to retract suppyling sufficient return pressure to operate the spool 32 of the flow control valve. It is further assumed that the system is operated in a manner which allows sufficient time for the chamber 44 to fully drain prior to reactivation.

Figure 5:
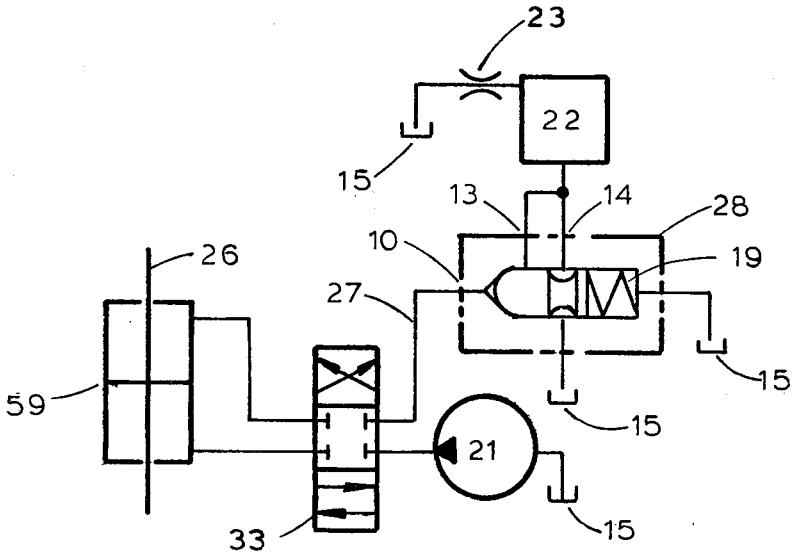
FIG. 5 shows schematically the invention as used with a double acting double rod actuator for cushioning at both ends.

Move to FIG. 5. The system shown is a common hydraulic system with a double acting double rod actuator 50, powered and cushioned in both directions. In this system the four way three position selector valve 52 ports return pressure from actuator 50 retract or extend cylinder to the invention which performs in the same manner as described for the system in FIG. 4.

Figure 6:
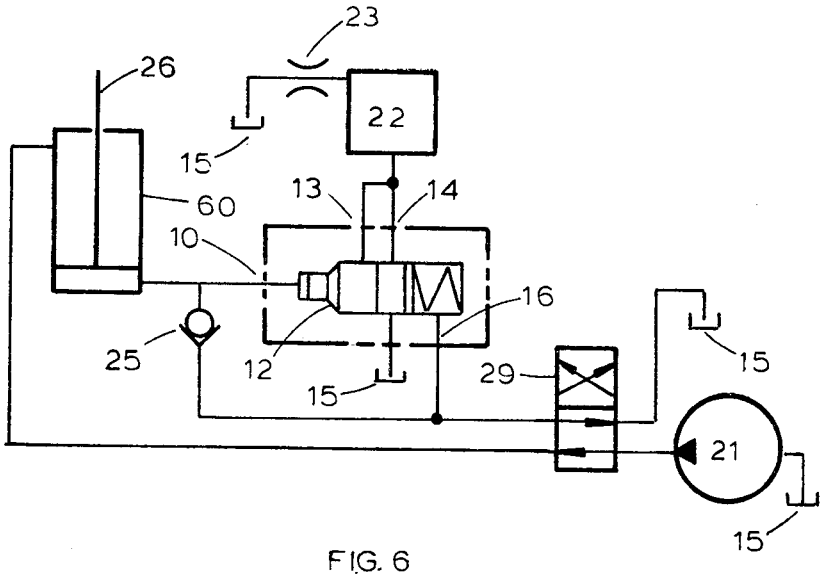
FIG. 6 shows schematically the invention as used with a double acting actuator for cushioning in the retract direction only using a version of the flow control valve illustrated in FIG. 3.
Figure 7:
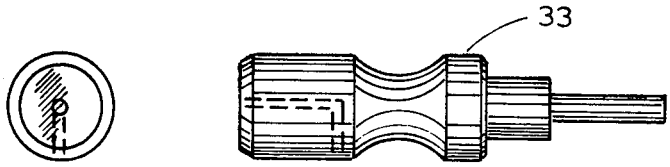
FIG. 7 shows spool 33 used in valve configuration shown in FIG. 30.
Figure 8:
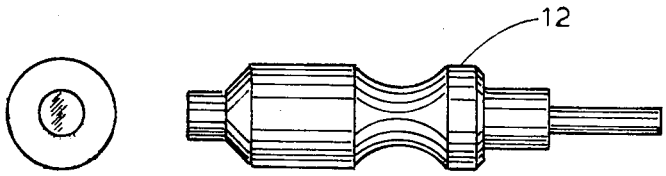
FIG. 8 shows spool 12 used in valve configuration shown in FIG. 3.
Figure 9:
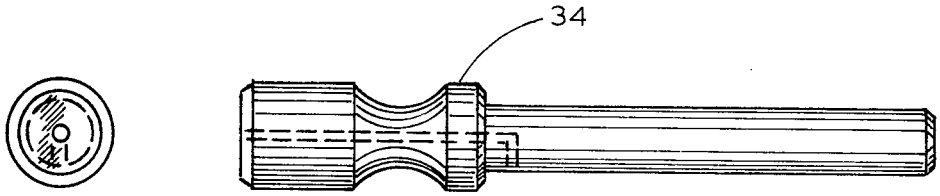
FIG. 9 shows spool 34 used in valve configuration shown in FIG. 32.

Move to FIG. 6. This system shows a double acting single rod actuator 56 cushioned in one direction only. The flow control valve in this case has been varied as shown in FIG. 3. The spool 58 which is illustrated in FIG. 8 is extended, exposing a smaller end area at port 30 than at port 60. During extend the pressurized fluid passes from directional control valve 62 through check valve 64 but is blocked from the flow control valve port 30 by pressure at port 60. The rod is not cushioned at the extend end. During rod 26 retract the return pressure moves spool 58 of the flow control valve opening port 42 and allows fluid to flow rapidly into chamber 44 and subsequently thru line restrictor 46, slowing fluid flow to cushion actuator rod 26 at the end of the retract stroke.

The flow control valve configurations illustrated in FIGS. 1 thru 3, with spools 32 and 58, would be used in slower cycling systems which would allow sufficient time for the return pressure 30, at the ends of actuator rod stroke, to decay, allowing spring 34 to return the spool 32 or 58 and dump the chamber 44 thru ports 38 and 40.

Figure 10:
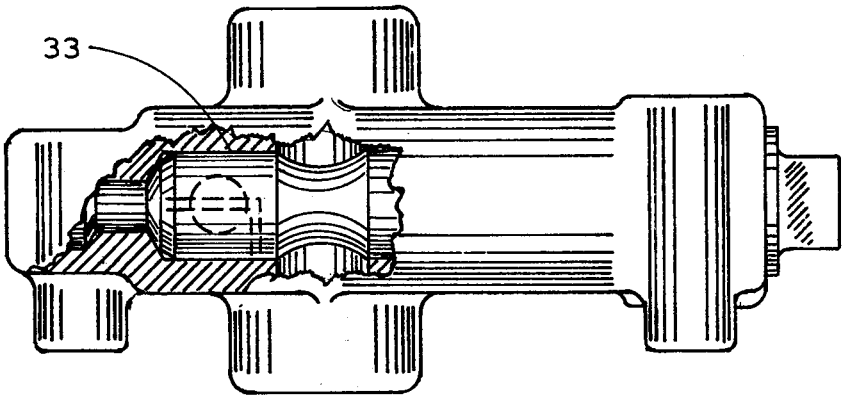
FIG. 10 shows a cutaway of the valve with special spool 33.
Figure 11:
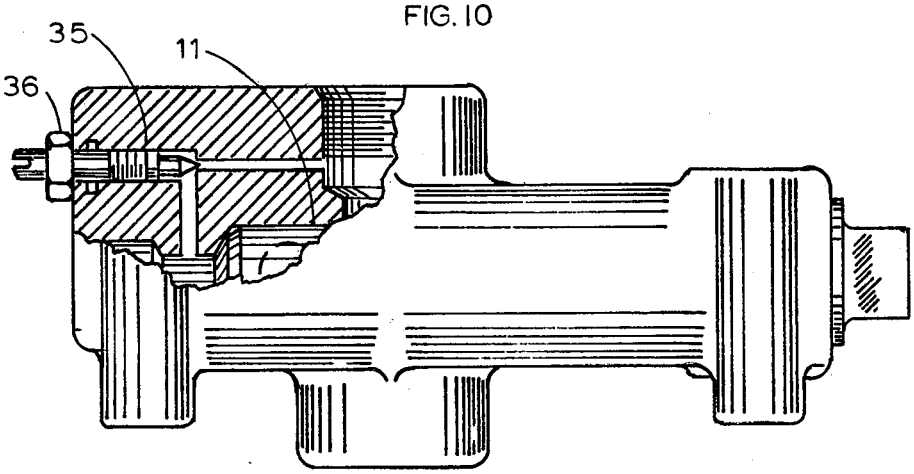
FIG. 11 shows the valve with a modified case for externally adjustable "bleed down" with needle valve 35.
Figure 12:
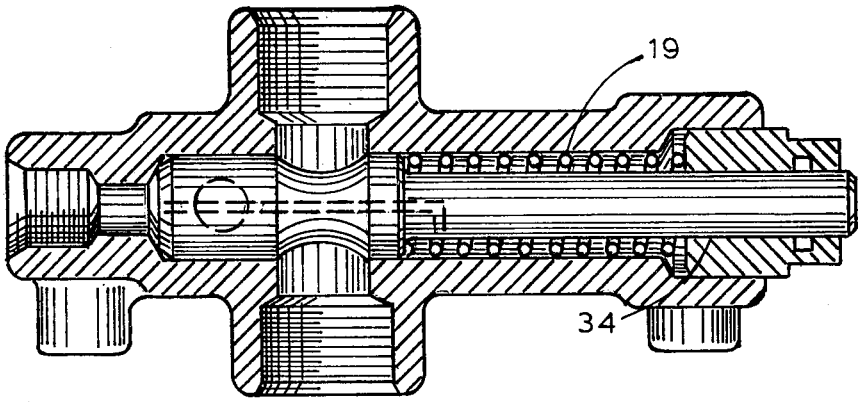
FIG. 12 shows a different version of the valve with a differential pressure spool 34.

The flow control valves illustrated in FIGS. 10 thru 12 have been modified to allow faster system cycling by applying various methods for "bleeding down" the pressure at 30 at a more rapid rate. The flow control valves illustrated in FIGS. 10 and 12 have passages in spools 52 and 66 respectively to allow faster spool return. These spool passages could be of various diameters, or have removable orficed inserts, to meet required return times. Flow control valve FIG. 31 has a solid spool 11 with a different case configuration equiped with an adjustable "bleed down" needle valve 68 and jam nut 70.

Figure 15:
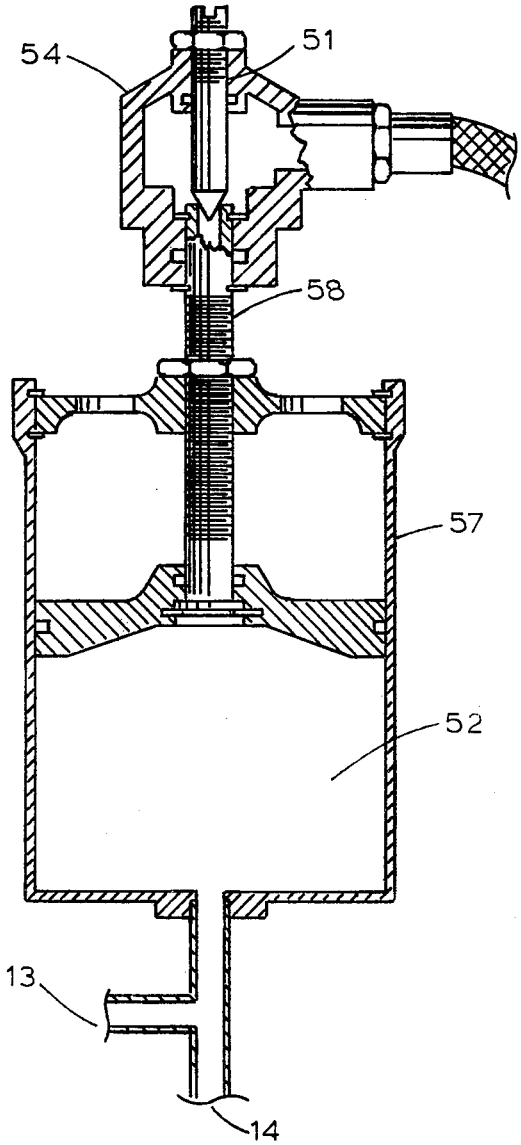
FIG. 15 shows an adjustable volume chamber and swivel needle valve for line restriction.

The point at which the actuator rod will start to decelerate can be adjusted by varying the volume of chamber 44. The rate of deceleration can be adjusted by changing the line restriction 46. FIG. 15 depicts an adjustable chamber 72 whose volume 74 can be adjusted by the hollowscrew 76. The rate of the actuator rod deceleration can be adjusted by moving the needle valve 78 of the swivel needle valve 80.

If the system shown in FIG. 5 had a double acting single rod actuator, rather than a double rod actuator, the cushioning would occur at different positions from the ends of the extend and retract positions due to the differences in the actuator cylinder volumes. This difference in volume is due to the rod being only on one side of the actuator piston. If a system requires that cushioning start at equal distances from both the retract and extend ends, two valves as shown in FIG. 1, can be used. Each rod direction would have its own cushioning system with properly sized chambers. In the retract direction the cushioning system would have a flow control valve equiped with a chamber a set amount less in volume than the volume of the actuator retract cylinder. The extend direction would have a flow control valve equipped with a chamber a set amount less in volume than the volume of the actuator extend cylinder. Thus the actuator could be cushioned at points equal distances from the end positions.

Figure 13:
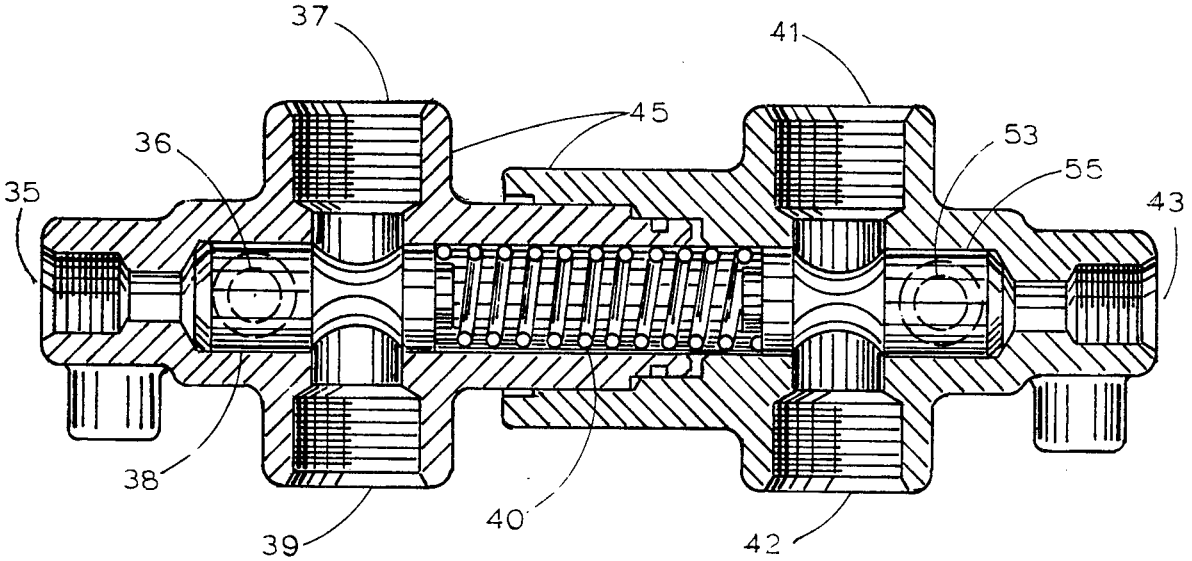
FIG. 13 shows a dual flow control valve used for symmetric cushioning of double acting single rod actuators.
Figure 14:
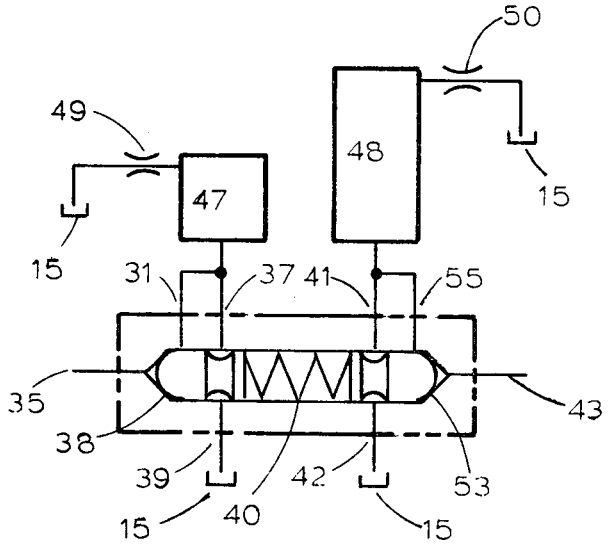
FIG. 14 shows schematically the dual flow control valve system.

Another method of obtaining symmetrical cushioning for a double acting single rod actuator would be to use a dual flow control valve as shown in FIG. 13. The dual flow control valve, FIG. 44, would be similar to the valve shown in FIG. 1 with a two part case 82 to accomodate individual control of the return fluid flow from each end of the actuator cylinder. For instance, if the actuator extend return pressure was connected to port 68 and the hydraulic circuit was as shown in FIG. 14, the return pressure will force spool 84 to the right, opening port 86 and closing ports 88 and 90. The fluid passes rapidly thru port 86 into the smaller chamber 92. When chamber 92 becomes full, fluid will pass thru the line restrictor 94, at a slow rate, to cushion the actuator rod at the end of the extend stroke. When the rod is fully extended, the pressure at 68 will drop, allowing the spool 84 to be returned by the spring 96. Ports 88 and 90 open allowing chamber 92 to drain. As soon as chamber 92 has emptied, the actuator is ready to be cycled in the opposite direction. On the actuator rod retract stroke, fluid passes from the actuator cylinder to port 98 FIG. 14. Return pressure at 98 forces spool 100, which is identical to spool 84, to the left opening port 102 and closing ports 104 and 106. The fluid passes rapidly thru port 102 into chamber 108. When chamber 108 becomes full, fluid will pass thru line restrictor 110 at a low rate to cushion the actuator rod at the end of the retract stroke. Ports 104 and 106 open allowing chamber 108 to drain, chambers 92 and 108 are sized to obtain the exact same point, from each end, where the actuator rod starts to be cushioned.

It should be understood that modifications may be made to the flow control valve and the cushioning system without deviating from the broader aspects thereof.

Now therefore I claim:

1. A device for cushioning in combination with a hydraulic actuator, said actuator having an actuator rod and cylinder, said device comprises: a valve body with an inlet port at one end connected to said actuator; means defining a chamber; a first passageway in said body connecting said inlet port to said chamber; said chamber being of less volume than the volume of said cylinder and said chamber having a restricted outlet at the top leading to drain and a connection at the bottom to a second passageway through said body to drain; a pressure responsive valve element means being cylindrical and reciprocally mounted in said body for alternately opening and closing said first and second passageways, means normally biasing said valve means to a position blocking said inlet port, said valve means, first, responding to said cylinder return fluid pressure at said inlet port for closing said chamber connection to drain and opening said inlet port to said first passageway for porting all said cylinder return fluid to said chamber; said cylinder return fluid in excess of said chamber volume passing through said chamber restricted outlet for cushioning said actuator rod at end of stroke, and second, said valve means responding to absence of said cylinder return fluid pressure, at said inlet port, for closing the connection of said inlet port and said first passageway and for opening said chamber bottom connection to said second passageway for emptying said chamber.

2. A device for cushioning a hydraulic actuator as in claim 1 wherein means are provided for varying flow through said chamber restricted outlet for controlling cushioning speed of said actuator rod.

3. A device for cushioning a hydraulic actuator as in claim 1 wherein means are provided for varying volume of said chamber for controlling said actuator rod cushioning time.

* * * * *